US009086241B2

(12) United States Patent
Bystedt

(10) Patent No.: US 9,086,241 B2
(45) Date of Patent: Jul. 21, 2015

(54) DEMOLITION HAMMER ARRANGEMENT FOR A REMOTE-CONTROLLED WORKING MACHINE EQUIPPED WITH A MANOEUVRABLE ARM

(75) Inventor: Gunnar Bystedt, Skellefteå (SE)

(73) Assignee: BROKK AKTIEBOLAG, Skellefteå (SE)

( * ) Notice: Subject to any disclaimer, the term of this patent is extended or adjusted under 35 U.S.C. 154(b) by 25 days.

(21) Appl. No.: 13/883,549

(22) PCT Filed: Nov. 2, 2011

(86) PCT No.: PCT/SE2011/051304

§ 371 (c)(1),
(2), (4) Date: Jul. 19, 2013

(87) PCT Pub. No.: WO2012/060772

PCT Pub. Date: May 10, 2012

(65) Prior Publication Data

US 2013/0300181 A1 Nov. 14, 2013

(30) Foreign Application Priority Data

Nov. 3, 2010 (SE) ..... 1051150

(51) Int. Cl.

| | |
|---|---|
| ***F27D 1/16*** | (2006.01) |
| ***E02F 3/36*** | (2006.01) |
| ***E02F 3/96*** | (2006.01) |
| ***B25D 9/04*** | (2006.01) |
| ***B25D 17/02*** | (2006.01) |

(52) U.S. Cl.

CPC ..... *F27D 1/1694* (2013.01); *B25D 9/04* (2013.01); *B25D 17/02* (2013.01); *E02F 3/3681* (2013.01); *E02F 3/966* (2013.01); *F27D 1/16* (2013.01)

(58) Field of Classification Search

CPC ..... F27D 1/1694

USPC ..... 299/30, 37.1, 37.2, 38.1, 37.3, 37.4, 299/37.5, 69; 173/42, 44, 190, 193, 184

See application file for complete search history.

(56) References Cited

U.S. PATENT DOCUMENTS

| | | | | |
|---|---|---|---|---|
| 3,090,983 | A * | 5/1963 | Modrak et al. | 15/104.07 |
| 3,346,300 | A | 10/1967 | Grant | |
| 3,389,755 | A * | 6/1968 | Grant | 173/44 |
| 3,584,816 | A * | 6/1971 | Salkeld | 173/44 |
| 3,586,113 | A * | 6/1971 | Grant | 173/34 |
| 3,757,875 | A * | 9/1973 | Gunning | 173/44 |
| 3,889,762 | A | 6/1975 | Sumner | |
| 4,319,739 | A * | 3/1982 | Skendrovic | 266/280 |
| 4,342,257 | A | 8/1982 | Weyer | |
| 4,871,211 | A * | 10/1989 | Aussel | 299/10 |
| 5,183,316 | A * | 2/1993 | Ottestad | 299/69 |
| 5,261,542 | A | 11/1993 | Robbie | |
| 5,269,382 | A * | 12/1993 | Ottestad | 173/200 |
| 5,285,858 | A * | 2/1994 | Okada et al. | 173/211 |
| 5,388,842 | A | 2/1995 | Piras et al. | |
| 6,517,164 | B1 * | 2/2003 | White | 299/37.5 |
| 6,802,377 | B2 * | 10/2004 | Foltz | 173/1 |
| 8,037,946 | B2 * | 10/2011 | Robson | 173/190 |

FOREIGN PATENT DOCUMENTS

| | | | |
|---|---|---|---|
| CN | 101392542 | A | 3/2009 |
| EP | 0534369 | A1 | 3/1993 |
| JP | 2-32361 | U | 2/1990 |
| JP | 8-3608 | A | 1/1996 |
| JP | 8-39235 | A | 2/1996 |
| SE | 505601 | C2 | 9/1997 |

OTHER PUBLICATIONS

International Search Report and Written Opinion received for PCT Patent Application No. PCT/SE2011/051304, mailed on Feb. 22, 2012, 15 pages.

International Preliminary Report on Patentability received for PCT Patent Application No. PCT/SE2011/051304, completed on Feb. 5, 2013, 20 pages.

* cited by examiner

*Primary Examiner* — David Bagnell
*Assistant Examiner* — Michael Goodwin
(74) *Attorney, Agent, or Firm* — Morrison & Foerster LLP

(57) ABSTRACT

The invention concerns a demolition arrangement for a remote-controlled working machine (1) equipped with a manoeuvrable arm (9), which machine, electrically powered and able to be driven on tracks (17), is principally intended for destruction and demolition work through the demolition processing with an impact tool (50) that operates through a hydraulically powered hammer (32) and where an operator walking next to the machine controls its various movements with a remote-control unit (4), which machine has a chassis (5) with an upper part (6) that is mounted in bearings on a lower part (7) in a manner that allows rotation for the rotation of the upper part in a horizontal plane around a vertical axis (8), whereby the manoeuvrable arm is supported at the upper part and including a series of arm parts (10, 11, 12) mutually joined to each other and that can be manoeuvred in a vertical plane by associated hydraulic cylinders (13, 14, 15), a link system (20) arranged at the free end of the arm that can be adjusted by means of a hydraulic cylinder (29) and designed as a combination of a coupling arrangement (21) for the attachment of a tool and a tilt or demolition arrangement (22) for the controlled oscillation around the centre of an axis (23) at the free end of the manoeuvrable arm of an impact tool inserted into the hammer. In order to make the work of demolition efficient, a rotary joint (35) is arranged at one of the arm sections (12) that are a component of the manoeuvrable arm (9), which rotary joint allows, through the influence of a rotator (36) a forward arm subsection (12:2) of the arm section, on which arm subsection the link system (20) is located, to place the end of the impact tool (50) that is located farthest forward against a working point in space though the forward arm subsection (12:2) being rotated around the longitudinal axis (A) of the arm section (12).

9 Claims, 7 Drawing Sheets

Figure 1:
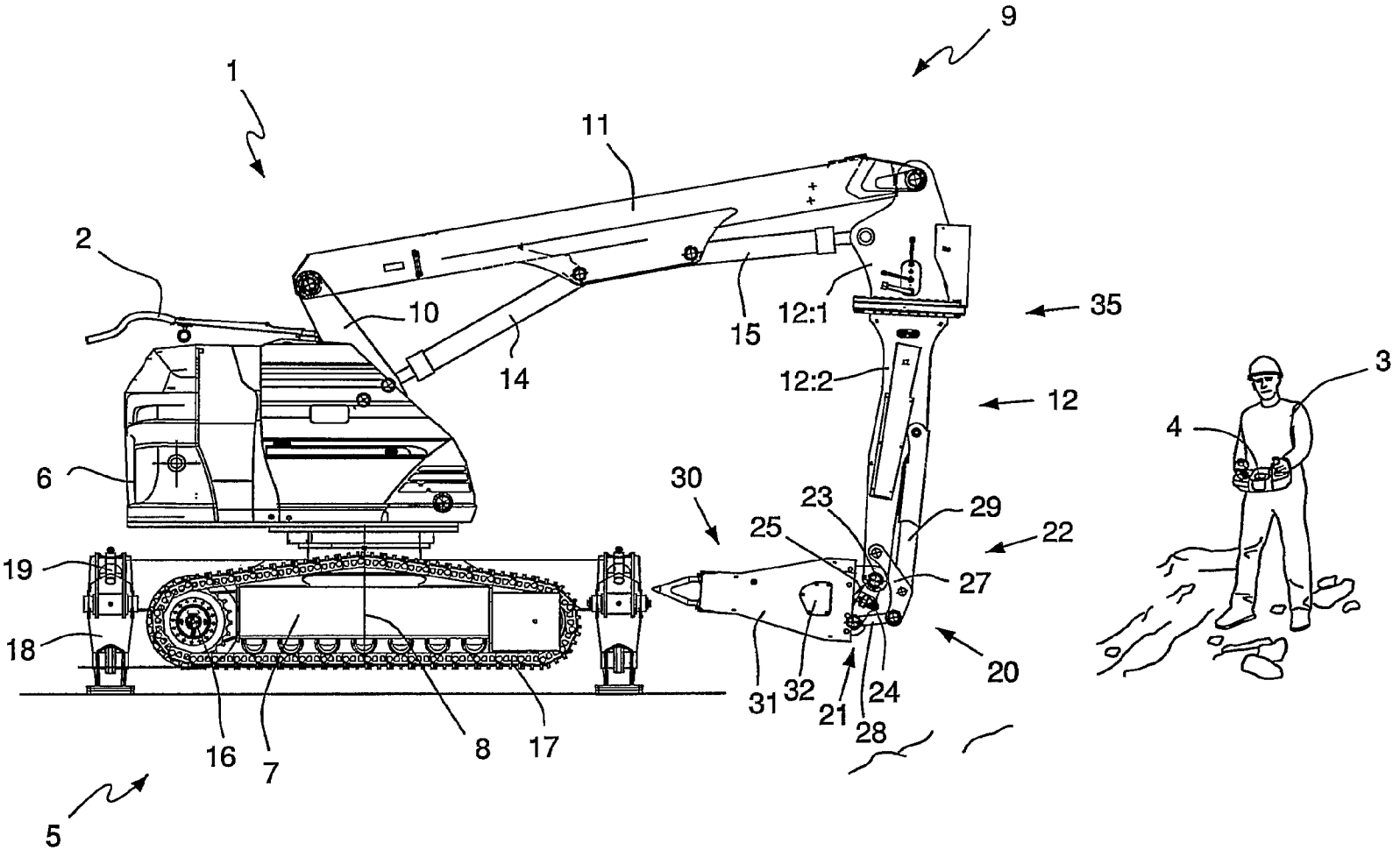

DEMOLITION HAMMER ARRANGEMENT FOR A REMOTE-CONTROLLED WORKING MACHINE EQUIPPED WITH A MANOEUVRABLE ARM

CROSS REFERENCE TO RELATED APPLICATIONS

This application is a U.S. National Phase patent application of PCT/SE2011/051304, filed Nov. 2, 2011, which claims priority to Swedish Patent Application No. 1051150-9, filed Nov. 3, 2010, each of which is hereby incorporated by reference in the present disclosure in its entirety.

The present invention concerns a demolition hammer arrangement for a remote-controlled working machine equipped with a manoeuvrable arm which machine, electrically powered and able to be driven on continuous tracks, is principally intended for destruction and demolition work, preferably through demolition processing by means of hydraulically powered impact tools.

This type of remote-controlled working machine is intended for various types of destruction and demolition work whereby the operator walking next to the machine controls its various motions with a remote-control unit of the type that is intended to be carried, by a harness, waist belt or similar, in front of the body of the operator, preferably in front of the stomach. The operator is in connection with the machine by cable or by wireless communication, for example Bluetooth or radio control. The working machine has its special area of application for operations that are heavy, risk-filled and require that it be possible to carry out the destruction and demolition work within a large working area, for example the destruction of fire-resistant material that is located on the inner surface of rotary furnaces used in the manufacture of cement, or metallurgy vessels of the type that is being used to an ever-greater extent in the manufacture of iron and steel, and in particular for melting, processing and transport of molten metals. What is common for the said types of vessel is that they have load-supporting outer walls of sheet metal and an internal fire-resistant lining of compressed clay or bricked stonework. When necessary, slag and parts of the fire-resistant lining material of the vessel that have been penetrated by slag must be removed. At regular intervals, the vessel must undergo a complete refurbishment and the worn-out lining replaced by a new lining, whereby the old worn-out lining is broken off and broken into pieces by the demolition work carried out by means of a demolition hammer, followed by removal from the furnace or vessel.

As has been mentioned above, the work of demolishing and breaking fire-resistant lining loose is a particularly extensive and arduous task. One of the requirements, therefore, that is placed on this type of working machine is that they should withstand the load and burdens that are placed not only on the tool, in order to carry out an efficient work of removal, but also on the working machine for refurbishment work. Furthermore, it is an advantage if the work can be carried out while the fire-resistant lining material still demonstrates relatively high temperatures such that the production equipment in question, independently of whether this is a case of a furnace or a vessel, can return to production as rapidly as possible, i.e. it must be possible to carry out the work of refurbishment with the least possible unproductive time of the production equipment in question.

As production equipment has become larger and larger, the interest in reducing the unproductive time of the equipment in order to achieve a greater degree of exploitation has become evermore important, not least due to reasons of economy. The ever-increasing dimensions of the equipment have led also to limitations in the ability of the working machines to carry out demolition processing of fire-resistant material, in particular on the inner surface of large drums and vessels, using advantageous angles of attack within a given working area. While it is true that the working area can be displaced by driving the working machine, the working area in itself will not be changed.

One purpose of the present invention, therefore, is to achieve a demolition hammer arrangement for a remote-controlled working machine of the type specified above that, equipped with a hammer for the work of demolition, can be adapted such that the forward tool part of the hammer reaches all parts of a working area with an advantageous angle of attack to the material that is to be processed. A second purpose is to achieve an arrangement for a working machine of the specified type that allows the work of refurbishment to be carried out before the production equipment has cooled, and remains at a relatively high temperature. A third purpose of the invention is to achieve a demolition arrangement for a working machine of the specified type that can be adjusted for work with a hammer at an advantageous angle of attack such that material can be removed not only through impacts but also through a breaker action, i.e. the demolition arrangement can be adjusted such that the breaking force and torque arm that are required can be acquired within a working area.

This purpose is achieved through the demolition arrangement according to the invention demonstrating the features and characteristics that are specified in claim 1. The invention concerns also the use of such a demolition arrangement for a remote-controlled working machine of the specified type for the refurbishment of metallurgy vessels according to claim 9.

It has proved to be particularly interesting to be able to use the present type of working machine for the destruction and refurbishment of the fire-resistant lining in metallurgy vessels, not least due to the improved control and ability to gain an overview that an operator who walks next to the working machine can obtain. This is particularly the case in comparison with the machines that have normally been used until now, in which the operator controls a working machine sitting in an operator's cabin.

Figures 2, 2A:
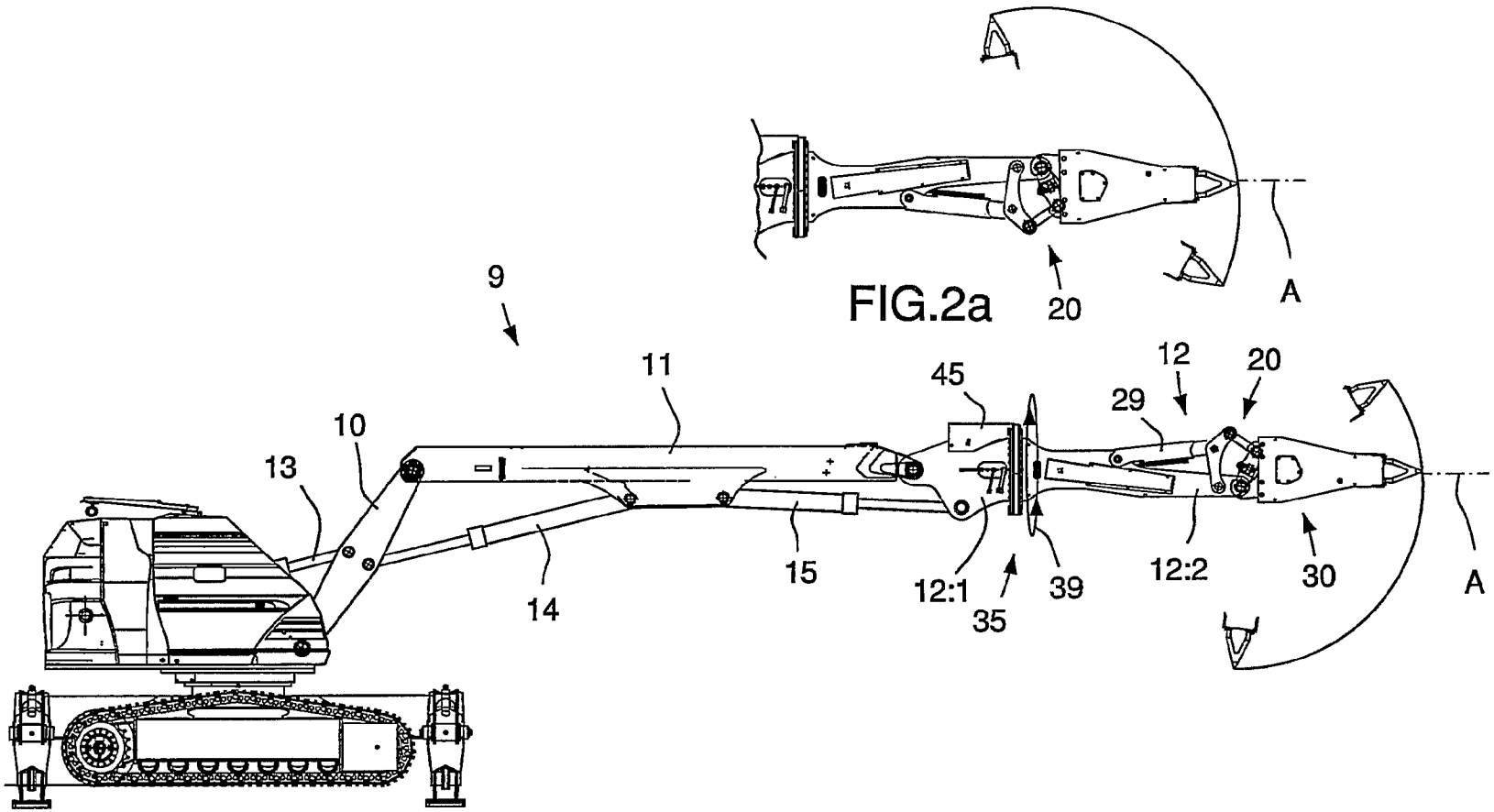
Figures 3, 4:
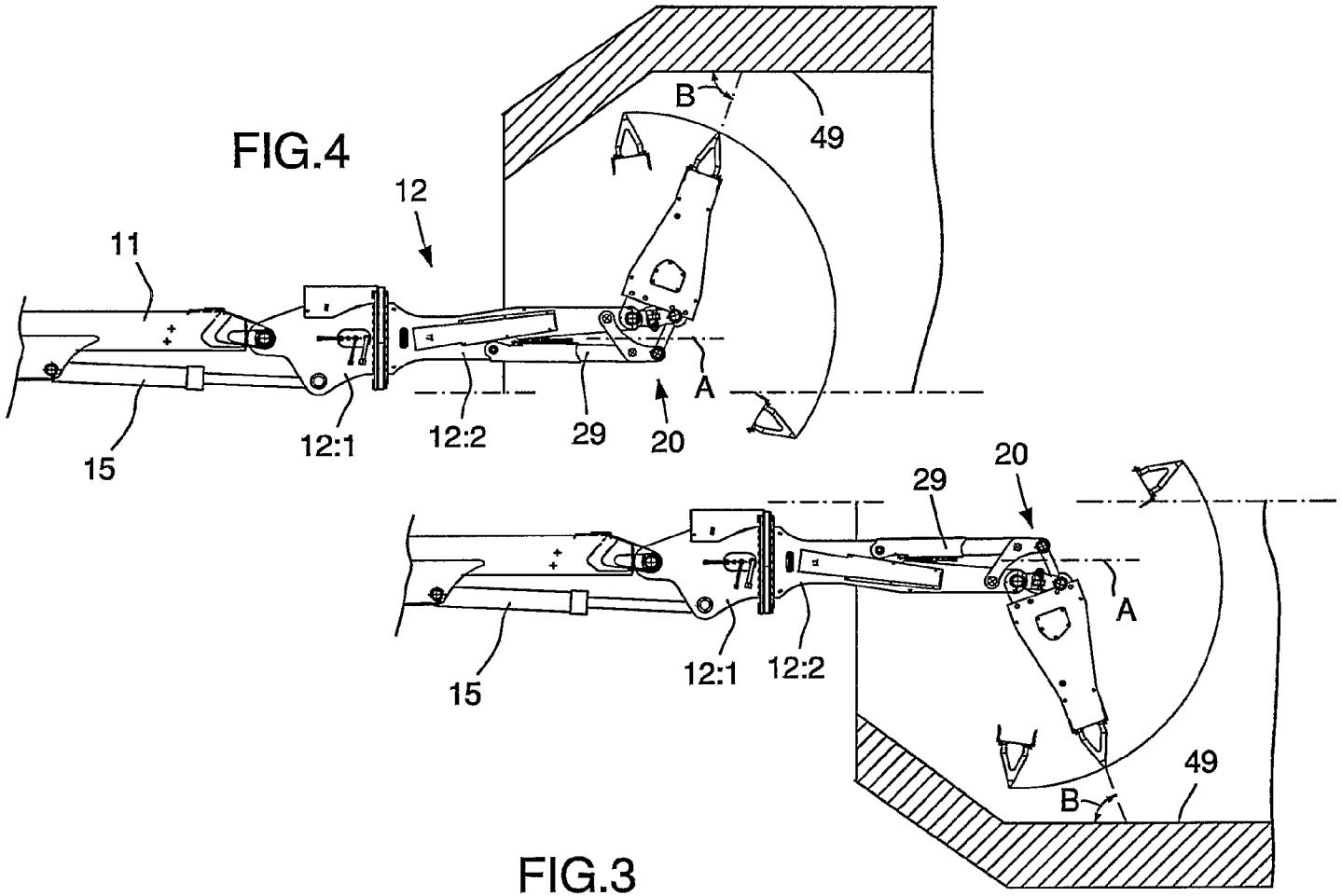
Figure 5:
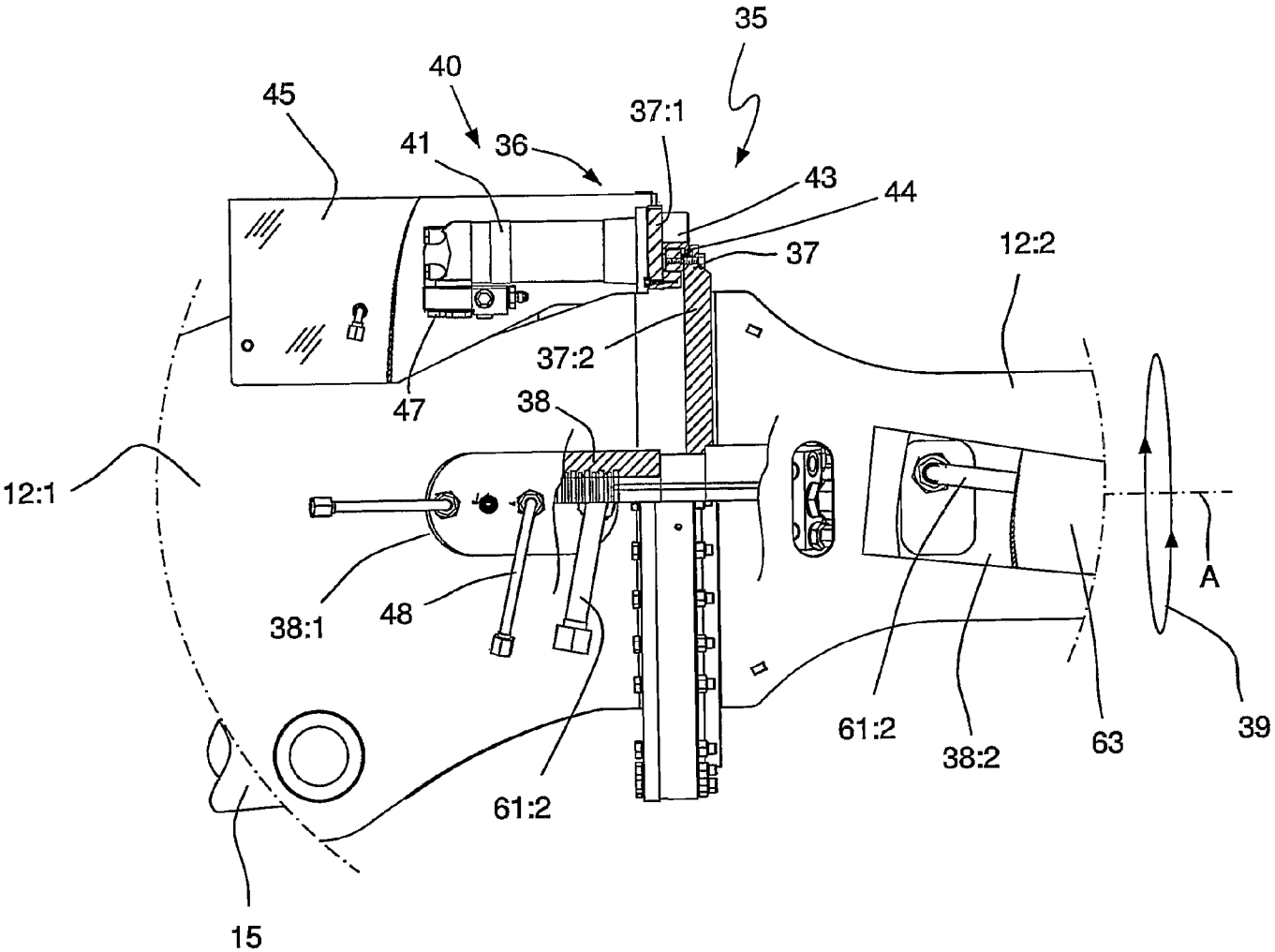
Figure 6:
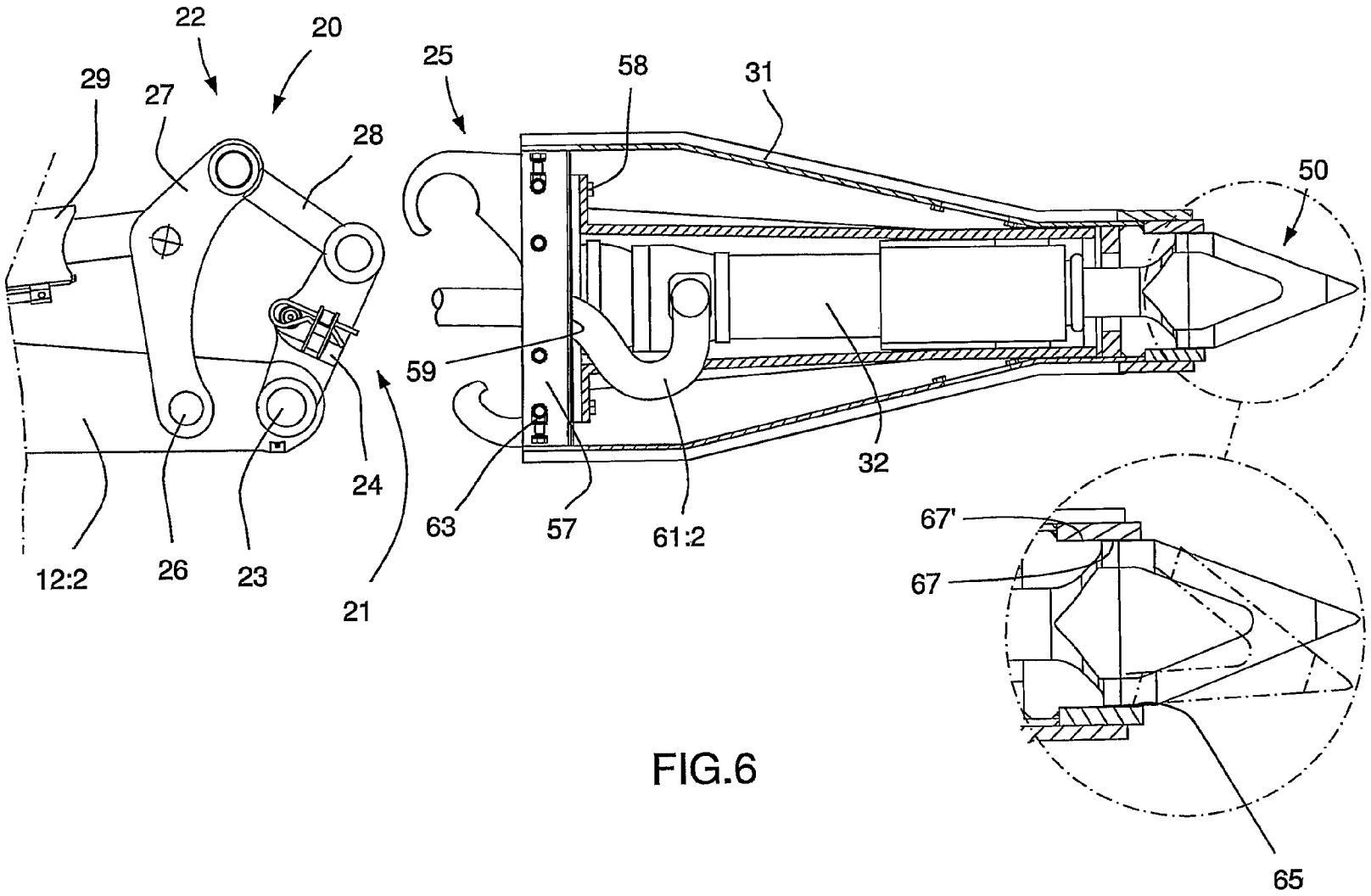
Figure 7:
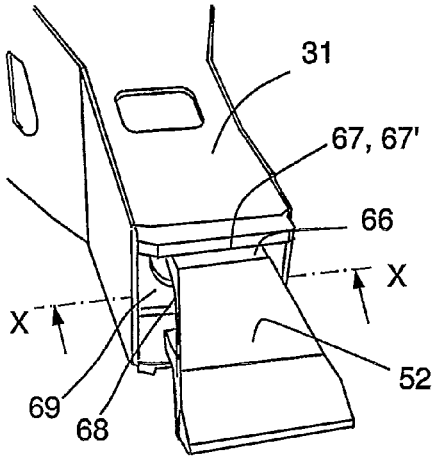
Figure 8:
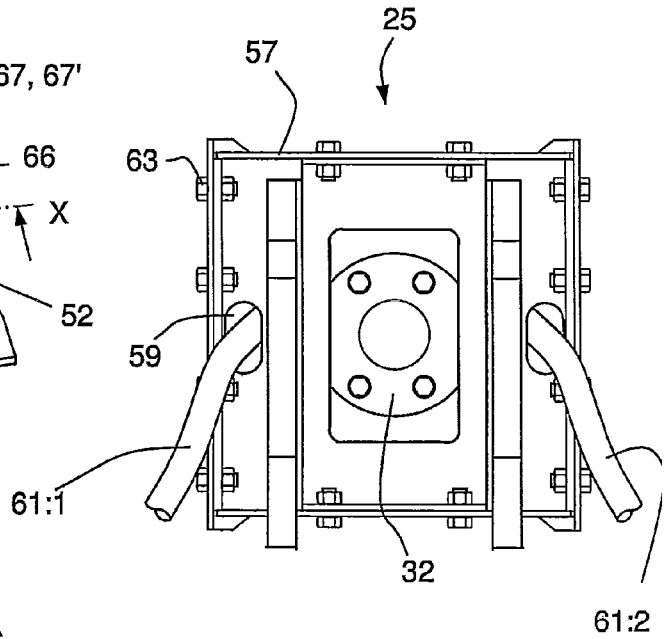
Figure 9:
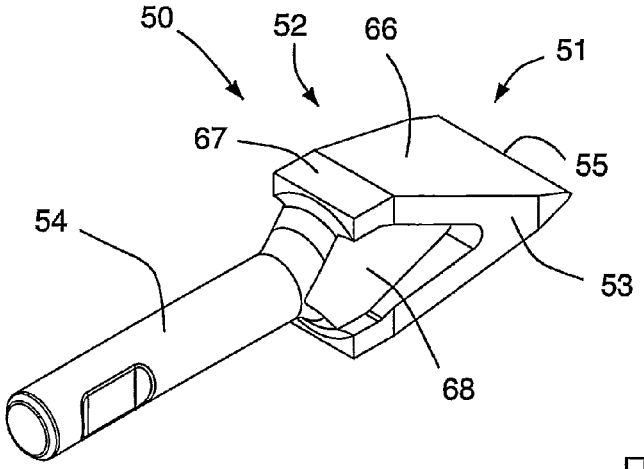
Figure 10:
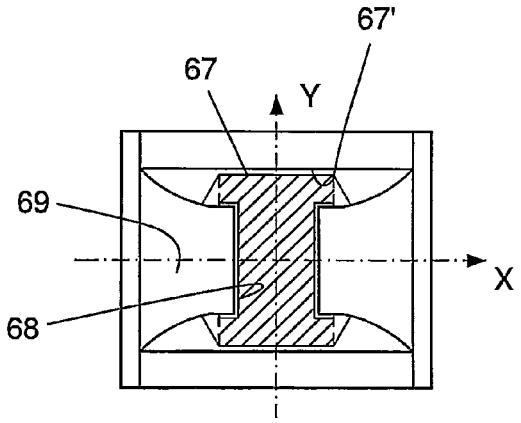
Figure 11:
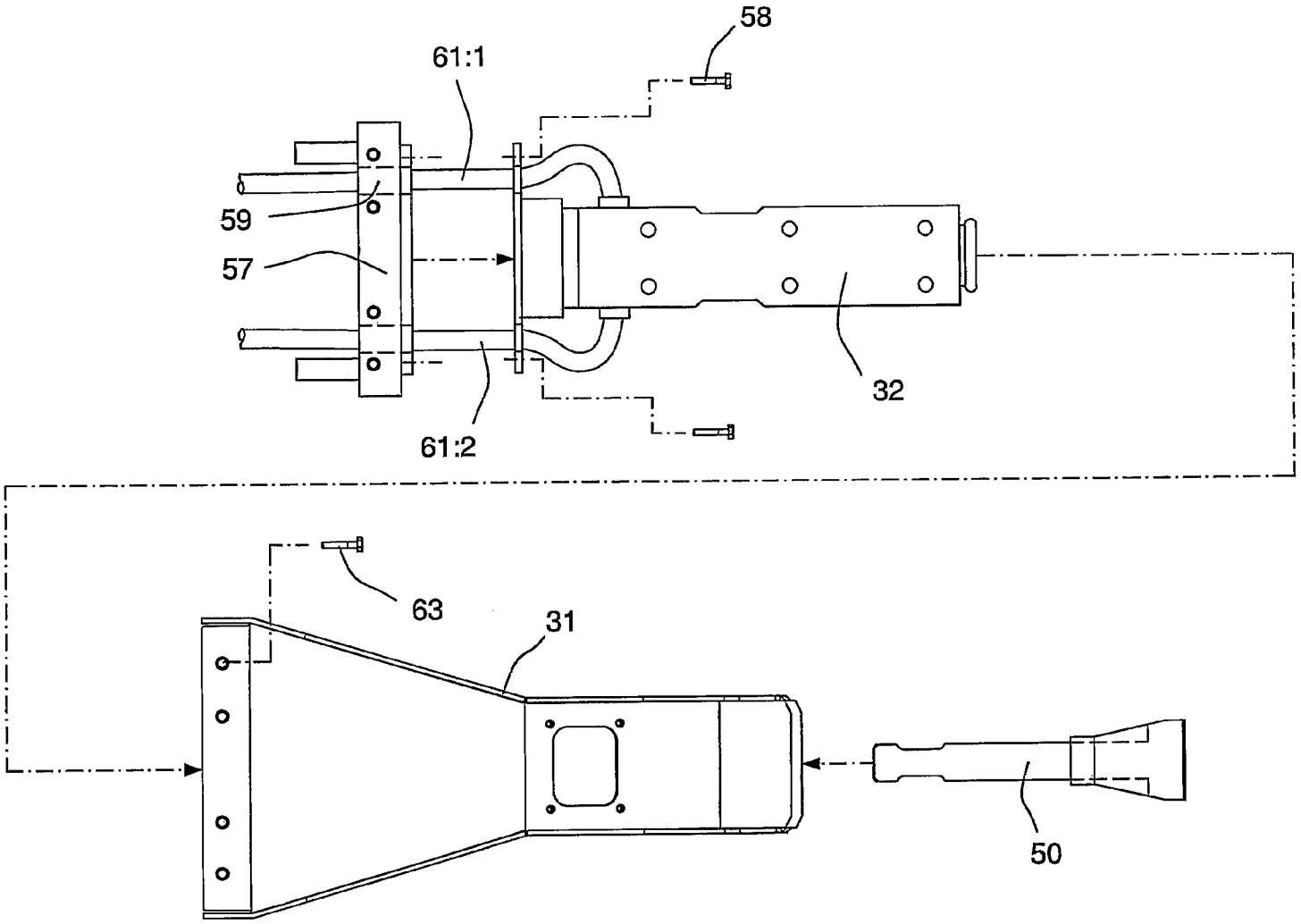

The invention will be described below in more detail with reference to the attached drawings, of which:

FIG. 1 shows a side view of a remote-controlled working machine equipped with a demolition arrangement according to the invention that, supported on the manoeuvrable arm of the working machine, has been placed into a retracted, inactive position, FIGS. 2 and 2*a* show a side view of the remote-controlled working machine according to FIG. 1 with the demolition arrangement placed into an essentially extended working position on the arm, and in an upwardly angled working position, respectively, FIGS. 3 and 4 show a side view in partial enlargement of a part of the demolition arrangement set in a first downwardly angled working position and in an alternative second upwardly angled working position during the processing of an inner surface of a metallurgy vessel, which inner surface has the form of an arc of a circle, FIG. 5 shows a side view, partially in longitudinal section, of a rotary collar with rotator and rotary coupling that is a component of the demolition arrangement, FIG. 6 shows a side view, partially in longitudinal section, through a demolition arrangement that is a component of a hammer system and including a hydraulically powered impact hammer that is inserted into a control box, FIG. 7 shows a perspective view of a forward part of the hammer system shown in FIG. 6, FIG. 8 shows a side view of a rear part of an attachment part that is a component of the hammer system, for the attachment of the hammer system at the free end of the manoeuvrable arm of a working machine, FIG. 9 shows a perspective view of an impact tool that is a component of the hammer system of the arrangement, FIG. 10 shows a cross-section seen along the line X-X in FIG. 7 and through the impact tool and a glide bearing for the linear control of the impact tool arranged in the control box of the hammer system, and FIG. 11 shows a view from above of the hammer of the demolition arrangement with its parts separated.

FIGS. 1 and 2 show a remote-controlled electrically powered working machine 1 designed as a demolition robot to which power is supplied along a cable 2. Such a remote-controlled working machine is manufactured and sold under the trademark "BROKK", and is such a working machine at which an operator 3 controls and operates the machine by means of a remote-control unit 4 that is carried on the body by means of a belt or harness. The working machine 1 generally comprises a chassis 5 with an upper part 6 and a lower part 7. The upper part 6 is mounted in bearings such that it can be rotated on the lower part 7 for oscillation in a horizontal plane around a vertical axis 8, whereby the turning force is exerted by means of a hydraulic motor (not shown in the drawings). A manoeuvrable arm generally denoted by reference number 9 is arranged on the upper part 6, which arm—including the mutually jointed and joined arm sections 10, 11, 12—can be manoeuvred in a vertical plane. Seen from the working machine, the said arm sections comprise a first arm section 10 that is mounted in a jointed fashion at one end at the upper part 6 for oscillation in a vertical plane by means of a first hydraulic cylinder 13 that acts between the said first arm section and the upper part, an extended second arm section 11 one end of which is united in a jointed manner with the second end of the first arm section for oscillation in a vertical plane by means of a second hydraulic cylinder 14 that acts between the said first and second arm sections, a third arm section 12, one end of which is united in a jointed manner with the second end of the second arm section and can be oscillated in a vertical plane by means of a third hydraulic cylinder 15 that acts between the said second and third arm sections. It should be understood that it would be possible in an alternative execution for the extended second arm section 11 to be telescopically designed and constructed from a number of components inserted one inside the other, with a hydraulic cylinder located within these, such that it is in this way possible, with a retained range, for it to be placed into an essentially withdrawn resting or transport position. The lower part 7 of the working machine is provided with a hydraulically active propulsion unit including hydraulic motors with individually driven wheel axles 16, whereby driving of the machine takes place by means of continuous tracks 17 that run in a parallel manner around the axes. At the corners of the lower part 7, i.e. at those parts where the sides of the lower part meet, support legs 18 that can be operated hydraulically are arranged. The support legs 18 and other mutually adjustable machine parts of the robot vehicle 1 can be operated in a conventional manner by means of hydraulic cylinders 19.

Now with reference to FIG. 6. A link system 20 is mounted in a jointed manner at the end of the manoeuvrable arm 9 that is turned away from the robot vehicle, which link system not only forms a combination of a coupling arrangement 21 for the attachment of a tool, but also forms a tilt or demolition arrangement 22 for the controlled oscillation of the attached tool around the centre of an axis 23 at the free end of the manoeuvrable arm 9. The coupling arrangement 21 comprises a link arm 24 that is united in a manner that allows pivoting around an axis at the end of the manoeuvrable arm 9 and intended to interact with a connector 25 at the tool designed in a complementary manner for the attachment of the tool onto the link arm. The tilt and demolition arrangement 22 comprises a bridge link 27 that is united in a manner that allows pivoting around an axis 26 that lies somewhat farther in along the manoeuvrable arm. The link arm 24 for interaction with the connector 25 of the tool and the bridge link 27 are in connection with each other in a manner that transfers motion through an intermediate link 28, whereby controlled oscillation of the tool around the central axis is achieved by means of a fourth hydraulic cylinder 29 that acts between the third arm section 12 and the bridge link 27. It should be understood that the tilt and demolition arrangement 22 achieves its greatest breaking power for the removal of pieces of material when the fourth hydraulic cylinder 29 moves towards its extended position. A hammer system 30 consisting of a hydraulically powered hammer 32 inserted into a control box 31 is attached at the coupling arrangement 21, and it is appropriate that the hammer system can be used for breaking loose, dividing and crushing fire-resistant material and slag on the inner surface of a furnace or metallurgy vessel. The hammer system 30 and its component parts will be described in more detail below.

With reference also to FIGS. 3 and 4, there is arranged an adjustable rotary joint 35 as a part of the invention, in the rear end of the third arm section 12 that faces the working vehicle 1, which adjustable rotary joint allows through the influence of a rotator 36 a forward arm subsection 12:2 of the third arm section 12 to be placed freely through it being rotated around the longitudinal axis of the third arm section, and thus relative to a rear arm subsection 12:1 of the third arm section, i.e. the rear arm subsection between which arm subsection and the second arm section 11 the third hydraulic cylinder 15 extends.

The rotary joint 35 is shown in more detail in FIG. 5 and, as this drawing makes clear, it herewith comprises a rotary collar 37 formed from ring-shaped rotation support surfaces 37:1 and 37:2, the principal planes of which intersect perpendicularly with the longitudinal axis A of the third arm section 12. The rotation support surfaces 37:1, 37:2 limit between them a ring-shaped inner compartment in which a rotary coupling 38 with a first end 38:1 and a second end 38:2 is located. The rotator 36 allows the forward arm subsection 12:2 and thus the hammer system 30 to be rotated around its own axis denoted by A in FIGS. 3 and 4, and as is illustrated with the arrowed loop 39. The rotator 36 has a hydraulically active driving means 40 comprising a hydraulic motor 41 that is in cogged engagement through a cogged wheel 43 arranged on a shaft with an outer ring 44 that is part of the rotary joint 35 and that is provided with a cogged ring in order to influence this in a rotary manner, and thus also to influence the forward arm subsection 12:2 of the third arm section 12 in a rotary manner such that the said forward arm subsection can be freely rotated in different directions around its longitudinal axis, denoted by A. The driving means 40 is located under a protective plate 45, the task of which is to protect the driving means not only from falling pieces of removed material but also, when working in and around metallurgy vessels and furnaces, the heat radiation that arises. The working chambers of the two consumers that are located on the rotatable forward arm subsection 12:2, i.e. not only the fourth hydraulic cylinder 29 for action at the bridge link 27 and for tilting of the hammer system 30 that is fixed attached at the rapid coupling, but also the impact mechanism of the hydraulic hammer 32, are serviced (supplied and evacuated) with the aid of the rotary coupling 38.

The rotary joint 35 and the rotary coupling 38 have axes of rotation or central axes each one of which is coaxial with the first axis A of oscillation. Supply and evacuation of hydraulic medium to the rotator 36 takes place directly through a first pair of cables 47 that do not necessarily pass the rotary coupling 38. A second pair of cables 48 is connected to the rotary coupling 38 and services the fourth hydraulic cylinder 29, which is intended for the breaking action and tilting of the hammer system 30, through this. The said two pairs of cables 47, 48 are connected in a conventional manner to a pump and tank, respectively, at the working machine 1 (not shown in the drawings). Due to the fact that the third arm section 12 is provided with a rotary joint 35 for the rotation of a forward arm subsection 12:2 into a freely chosen direction, in never-ending circuits, around the longitudinal axis A of the arm section, in combination with the tilt and demolition arrangement 22 is the link arrangement] that carries out controlled oscillation of the hammer system 30 that is located at the forward end of the arm subsection 12:2, the said forward end can not only be directed to a specific point in space according to the three fundamental coordinates that determine its motion, but it can also reach any freely chosen point while retaining the desired angle of attack B of the forward arm subsection 12:2 of the third arm section 12 against a surface.

As FIGS. 3 and 4 make most clear, the front end 12:2 of the end of the hammer system 30 that is located farthest forward can, through the influence of the rotary joint 35 and rotator 36, be directed towards the inner surface of a surrounding wall, for example following the inner surface of an arc of a circle of a furnace wall that is lined with a fire-resistant material 49 or following a metallurgy vessel such that the said forward end is located in contact with any freely selected point of the wall surface, while at the same time the tilt or demolition arrangement 20 of the fink system, for controlled oscillation of the tool around the centre of an axis in the of the manoeuvrable arm, in which the tilt or demolition arrangement 20 is located facing away from the selected point of the wall surface. Due to the fact that the tilt or demolition arrangement 20 of the link system can be oriented such that it is facing away from the selected working point of the hammer system 30, the torque arm that the tilt and demolition arrangement 22 offers can be efficiently used for breaking loose crushed and demolished material. The reason for this, naturally, is that the outermost arm section 12:2 can be adjusted such that the fourth hydraulic cylinder 29 always has the force required to work in positions where it can deliver the greatest breaking force to the tilt and demolition arrangement 20, namely at the place at which the hydraulic cylinder moves towards its extended position.

FIG. 6 shows a longitudinal section through the hammer system 30 that is a component of the arrangement, which, as has been mentioned above, includes a mechanically stable control box 31 and a hammer 32 inserted into this, whereby the control box, which is manufactured from solid sheet metal and which becomes more narrow towards its front, serves not only as protection from heat for the hammer but also as a sound-absorbing mounting support for the said hammer. The hammer 32 has a hydraulically powered impact mechanism connected to the working machine 1 in order to generate impacts against the neck of a chisel-shaped impact tool 50 intended to be placed in a chuck that is a component of the hammer in a retaining manner, and placed in contact with the material that is to be broken with force.

The impact tool 50 is shown in more detail in FIG. 7, whereby the impact tool includes a flat or chisel-shaped head 51 with a defined broad side 52 and a narrow side 53, in order to be able to efficiently break fire-resistant wall material 49 and slag from furnaces and metallurgy vessels and similar (see also FIGS. 3 and 4). The impact tool 50 has, further, a circularly symmetrical shaft 54 whereby it should be noted that the head is considerably thicker than the shaft and that the head has a relatively long defined cutting edge 55. The edge 55 of the impact tool 50 is intended to be placed in contact by a force, in the manner of a wedge, against the surface that is to be processed by the influence of the displaceable arm 9 of the working machine 1, in particular the force that the tilt and demolition arrangement 20 offers when the fourth hydraulic cylinder 29 moves towards its extended position.

As is made most clear by FIGS. 6, 8 and 11, the hammer 32 is adapted to fit into the control box 31 and is attached to this by screws 56, in a manner that allows it to be removed. The jacket of the control box 31 is formed of sheet metal and extends from the bottom of the hammer 32 to its front. The control box 31 demonstrates a rear wall piece 57 designed to form a part of the connector 25 of the hammer system 30 for the attachment of the hammer system to the link arm 24 of the third arm section 12, which link arm serves as a rapid coupling. The hammer 32 is attached to the end piece 57 in a manner that allows it to be removed by means of fixture fittings in the form of screws 58 that are inserted into the forward part of the control box in a manner that is controlled by their form. The rear end piece 57 is provided with openings 59 through which a third pair of cables 61 with cables denoted by 61:1 and 61:2 for the supply of the impact mechanism of the hammer 32 with hydraulic medium extend.

As is made most clear by FIG. 5, the forward arm subsection 12:2, which can be rotated, is provided at two of its opposite side walls with access openings 62:2 for the second end 38:2 of the rotary coupling 38. In a corresponding manner, the rear arm subsection 12:1 is provided with access openings 62:1 for the first end 38:1 of the rotary coupling 38. The cables 61:1 and 61:2 extend forwards, one on each side of the forward arm subsection 12:2 that can be rotated, connected to the second end 38:2 of the rotary coupling and passing through the said second access openings 62:2. A protective plate 63 is attached one on each side of the forward arm subsection 12:2 that can be rotated. These protective plates 63 cover the cables 61:1, 61:2 and it is their task to protect these from falling pieces of loosened material and from heat radiation. The cables 61:1 and 61:2 that are members of the pair of cables 61 extend forwards to the hammer 32, passing in through openings 59 in the rear end piece 57 of the control box 31. Careful study of FIG. 11 should enable it to be understood that the hammer 32 is intended to be attached to the end piece 57 and that both of these parts form a unit that can be inserted into the control box as a pre-mounted unit. The end piece 57 is inserted into the broader rear part of the control box 31 during mounting and is fixed to it by means of the screws 63. The hammer 32 can be easily removed from the control box 31 as a unit together with the end piece, by removing the end piece 57.

The enlargement of detail shown in FIG. 6 illustrates with dash-dot contours how the breaking forces and torques that arise during demolition work can influence the impact tool 50 and bend it away. One part of the present invention forms the basis for avoiding this problem and making it possible to apply relatively large breaking forces to the impact tool in order to make the destruction and demolition work, for example during the refurbishment of metallurgy vessels, more efficient.

FIGS. 7, 9 and 10 show in more detail how the hammer system 30 that is a part of the invention is designed to absorb breaking forces from the tilt or demolition arrangement 20 of the link system during destruction and demolition work, i.e. where the chisel-shaped impact tool 50 is used to break pieces of material loose. As FIG. 7 makes most clear, the control box 31 at its front is provided with an opening 65 through which a chisel protrudes, through which the chisel-shaped head 51 of the impact tool 50 extends out of the box. The opening 65 through which the chisel protrudes is designed to act as a glide bearing for the linear control of the head 51 of the impact tool 50 during the axial reciprocating working motion of the impact tool with the ability also to withstand the static forces and torques in two perpendicular planes denoted X and Y in FIG. 10. For this purpose, the opening 65 and the chisel-shaped head 51 of the impact tool 50 have been given, when seen in cross-section, at least in regions profiles that correspond to each other, demonstrating a number of parallel, principally plane control surfaces that face each other.

The impact tool is shown in more detail in FIG. 9 and, as the drawing makes clear, the broad side 52 of the cutting head 51, which has a flat shape and when viewed in cross-section is essentially perpendicular, demonstrates the appearance of a V-shaped cutting edge, the principal surface of which is limited by two plane surfaces 66 that diverge from the edge and that transition into two plane parallel support surfaces 67 in the backwards direction towards the shaft. With reference also to FIG. 10, these plane parallel support surfaces 67 form, in interaction with correspondingly designed support surfaces 67' in the open wall of the opening 65 that allows the chisel to protrude a first linear control of the impact tool 50, which linear control is intended to absorb forces in a first working plane Y of the hammer system 30. A complementary second linear control is formed through the narrow sides 53 of the cutting head 51 having been assigned groove-shaped indentations 68 and through the open wall of the opening 65 having been assigned two protrusions 69 that face each other and are directed towards the side and that, extending into the grooves, form two control surfaces that run parallel. Through a combination of the first linear control arranged at the broad side 52 of the cutting head 51 and the second complementary linear control arranged at the narrow side 53, a significant part of the breaking forces and torques that arise during breaking loose and crushing material can be absorbed, in particular during the heavy work of loosening fire-resistant material and slag from the inner surface of a furnace or metallurgy vessel.

The invention is not limited to that which has been described above and shown in the drawings: it can be changed and modified in several different ways within the scope of the innovative concept defined by the attached patent claims.

The invention claimed is:

1. Demolition arrangement for a transportable working machine equipped with a manoeuvrable arm which is pivotable about a vertical axis and is intended for removal and demolition, in particular for the removal of slag and refractory material that is located on the inside of a furnace or metallurgical vessel, the demolition arrangement comprising:

an impact tool attached in a front end of a hydraulic hammer, a tilting or breaking device that is arranged between a free end of a control arm and the hammer and which, by action of a link system allows the attached impact tool to form a moment arm pivoted about the center of an axis of the free end of the control arm, and a rotary joint which by action of a rotator allows a front arm portion of the control arm and thereby the impact tool to be rotated about its own longitudinal axis, wherein the hydraulic hammer for the impact tool forms part of a hammer system comprising a substantially closed control box which is formed of joined steel plates and is openable via a rear wall end piece forming part of the control box, wherein in the control box the hydraulic hammer is adapted to be received in a retaining manner, the rear wall end piece on one side has a connector designed for quick coupling with the free end of the control arm by cooperation with a corresponding coupling member provided in the link system and that the rear wall end piece on a second side has a part to which a rear flange like portion of the hammer is mountable, and wherein the control box in a front end is provided with an opening in which a chisel-shaped portion of a head included in the impact tool is non-rotatable but slidably guided for performing movements in its axial direction.

2. Demolition arrangement according to claim 1, wherein the control box having a front thinner part and a rear wider part and the rear wall end piece fits into the rear wider portion of the control box and is fixed thereto by screws.

3. Demolition arrangement according to claim 2, whereby wherein the hydraulic powered hammer and the rear wall end piece are designed together to form a unit which form allows insertion into the control box front thinner part.

4. Demolition arrangement according to claim 3, wherein the hydraulic powered hammer is with its flange like portion removable mountable in the rear wall end piece by screws.

5. Demolition arrangement according to claim 1, wherein the rear wall end piece is provided with openings through which hydraulic cables extends with the task of supplying a percussion unit in the hydraulic powered hammer with hydraulic fluid.

6. Demolition arrangement according to claim 1, wherein the head is designed as a V-shaped cutting edge with a defined broad side and narrow side.

7. Demolition arrangement according to claim 1, wherein a broad side of the impact tool is limited by two plane surfaces that diverge away from a cutting edge and that in a direction backwards towards a shaft transition into two plane parallel support surfaces that, in interaction with correspondingly designed support surfaces in the open wall of the opening, form a first linear control for the impact tool.

8. Demolition arrangement according to claim 7, comprising a supplementary second linear control formed through the interaction between two protrusions that face each other and groove-shaped indentations arranged in the narrow sides of the cutting head and the open wall of the opening, respectively.

9. A method of using a demolition arrangement, comprising:

providing the demolition arrangement of claim 1; and remotely controlling the demolition arrangement for the refurbishment of metallurgy vessels.

* * * * *